United States Patent [19]

Adolph

[11] Patent Number: 4,542,856

[45] Date of Patent: Sep. 24, 1985

[54] HAMMER BREAKER

[75] Inventor: Manfred Adolph, Langenfeld, Fed. Rep. of Germany

[73] Assignee: Lindemann Maschinenfabrik GmbH, Düsseldorf, Fed. Rep. of Germany

[21] Appl. No.: 531,812

[22] Filed: Sep. 13, 1983

[30] Foreign Application Priority Data

Sep. 14, 1982 [DE] Fed. Rep. of Germany ..... 3233985

[51] Int. Cl.[4] ..... B02C 13/09

[52] U.S. Cl. ..... 241/69; 241/79; 241/186.2; 241/189 R

[58] Field of Search ..... 173/94, 69; 241/186 R, 241/79, 186.1, 186.2, 186.3, 189 R, 187, 190

[56] References Cited

U.S. PATENT DOCUMENTS

| | | | |
|---|---|---|---|
| 2,706,088 | 4/1955 | Paul | 241/186 R |
| 2,756,001 | 7/1956 | Kemp | 241/186 R |
| 3,202,367 | 8/1965 | Nixon | 241/189 R |
| 3,447,758 | 6/1969 | Oznobiohine | 241/189 R |
| 3,516,613 | 6/1970 | Gilbert | 241/189 |
| 4,049,206 | 9/1977 | König et al. | 241/189 A |
| 4,193,556 | 3/1980 | Linnerz et al. | 241/189 R |

*Primary Examiner*—James M. Meister
*Assistant Examiner*—John L. Knoble
*Attorney, Agent, or Firm*—Toren, McGeady, Stanger, Goldberg & Kiel

[57] ABSTRACT

In a hammer breaker for breaking and crushing scrap material, in which a hammer rotor having a plurality of hammers pivotally mounted thereon is rotatably mounted in a housing having an inlet for the material to be broken and crushed, a passage for receiving the broken and crushed material from the hammer rotor, and an outlet from the passage covered by a classifying grate, the passage is divided by a perforated baffle into a pair of chambers arranged in series in the direction of rotation of the rotor. The first chamber is provided with the classifying grate outlet, and the second chamber leads back to the material inlet so that air is able to circulate around the rotor via the perforated baffle and the second chamber, thus reducing the throughput of air of the machine and correspondingly reducing the size of the dust extractor which is needed.

18 Claims, 2 Drawing Figures

HAMMER BREAKER

Figure 2:
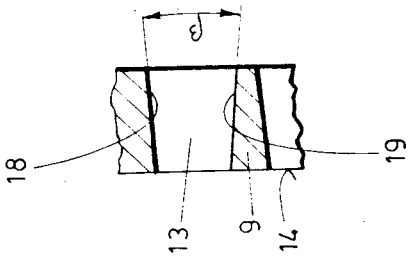

This invention relates to hammer breakers for breaking and crushing scrap material, particularly scrap metal, in which a hammer rotor having a plurality of hammers pivotally mounted thereon is rotatably mounted in a housing having an inlet for the material to be broken and crushed, a passage for receiving the broken and crushed material from the hammer rotor, and an outlet from the passage covered by a classifying grate. An example of such a hammer breaker is described and shown in German Pat. No. 1,272,091.

Hammer breakers of this kind are being used to an increasing extent for breaking and crushing car bodies, ranges, refrigerators, washing machines, steel furniture and the like. As the action of the hammers mounted pivotably on the rotor depends essentially on their weight and the speed of rotation, maximum possible speeds of for example 55 m/s or more are selected in the interests of high efficiency. The revolving rotor then leads to the hammer breaker acting also somewhat like a radial-flow compressor.

To ensure dust-free operation of the hammer breaker, a dust extractor must be provided. This is generally constructed with two stages and is explosion pressure-resistant, normally consisting of a cyclone pre-cleaner and a wet scrubber connected to the outlet side of the hammer breaker. With the machines known hitherto, the size and extraction capacity of the dust extractor is determined solely by the high air capacity, which has been accepted as not controllable, of the hammer rotor and not by the capacity required only for the dust quantity actually to be extracted. This has led to the dust extractor not only having unnecessarily high energy consumption but, on account of the over-dimensioning which has been accepted as unavoidable, also being relatively costly and noisy.

The object of the invention is to provide a hammer breaker of the kind described which renders it possible to combine with it or connect to its outlet side a dust extractor which is not oversized, but can be dimensioned according to the requirements arising from the amount of dust generated by the breaker.

According to the invention this object is achieved by reducing the blower effect of the hammer rotor in the hammer breaker by dividing the passage into at least two chambers arranged in series in the direction of rotation of the rotor, creating an auxiliary path for the return or circulation of air which minimises the blower effect of the hammer breaker and reduces the amount of air which passes through the outlet to the dust extractor.

Preferably the first chamber of the passage is bounded radially outwardly of the rotor by the classifying grate, and the second chamber is bounded radially outwardly of the rotor by a curved wall of the housing which extends from the grate to the material inlet whereby the second chamber opens towards the material inlet, thus creating a circulatory path for air around the rotor.

In a construction which has proved particularly efficient, the hammer rotor is mounted with its axis horizontal and the passage is located above the rotor, the outlet covered by the classifying grate being in the roof of the passage above the rotor. The classifying grate may be flat, and preferably horizontal, or may be arcuate.

The separation between the two chambers is preferably achieved by a baffle which has openings extending through it for the passage of air and which preferably extends at an obtuse angle from the edge of the classifying grate nearest the material inlet in the direction of rotation of the rotor to a position close to the impact circle described by the rotor hammers.

Figure 1:
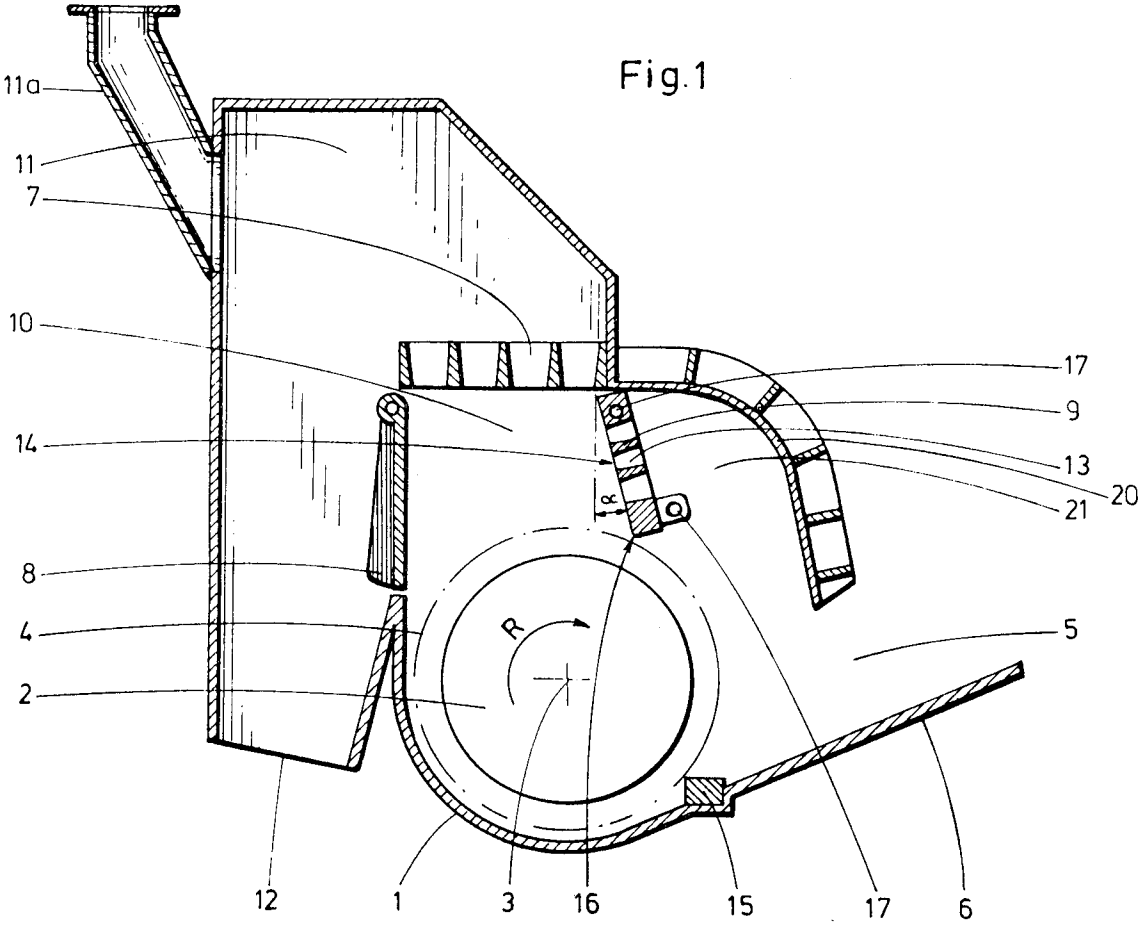

A preferred example of a hammer breaker in accordance with the invention will now be described with reference to the accompanying drawings, in which:

FIG. 1 is a diagrammatic section through the apparatus in a plane perpendicular to the axis of the hammer rotor; and, FIG. 2 is a scrap section, to a larger scale, showing a detail of the apparatus shown in FIG. 1.

The hammer breaker illustrated comprises a housing 1 in which a hammer rotor 2 is mounted with its axis 23 horizontal and is arranged to be driven to rotate in the direction R. The rotor 2 is equipped, in a manner which is known per se, with rotor hammers (not shown) which form the actual crushing tools, and which are freely pivotable in radial planes about their respective mounting means at the periphery of the rotor 2. The circle 4 indicated by a dot-and-dash line represents the so-called hammer impact circle 4 described by the outer edges of the rotor hammers.

The housing 1 has an inlet 5 for the material which is to be treated, for example car bodies, and which is received by the breaker, usually already in a highly compressed state, over an inclined surface 6 leading to an anvil 15 adjacent the impact circle 4. A classifying grate 7 forming a material outlet is disposed above the hammer rotor 2 at the top of a shaft or chamber 10 having at one side a ejector flap 8 for coarse pieces of scrap which have been crushed inadequately or not at all, and at the opposite side in the direction of rotation R a baffle 9 which will be described in more detail below. A hood 11 above the classifying grate 7 serves to collect and deflect the crushed scrap passing through the grate, and is provided with a pipe connection **11*a* for a dust extractor, not shown. The hood 11 has a lower opening 12** through which the treated scrap material falls onto or into suitable transport devices.

The classifying grate 7 is mounted substantially horizontally, and the baffle 9 is attached to the housing beneath the classifying grate 7 adjacent its edge which is nearest the material inlet 5 in the direction of rotation R. The baffle 9 slopes downwards and slightly outwards towards the material inlet 5, forming an angle $\alpha$ between the upstream baffle surface 14 and a plane perpendicular to the plane of the classifying grate 7 which may be between about 10° and 30°. The lower edge of the baffle is located close to the impact circle 4 and is provded with a further anvil edge 16 for crushing of material by the hammers of the rotor 2. The baffle is fixed at its upper and lower edges by fixings 17.

The baffle is provided, as an essential feature, with through-holes or openings 13, and these are preferably dimensioned at least so as to be able to let through those pieces of scrap which are sufficiently crushed and/or compacted to pass through the classifying grate 7. The air circulation intended by the invention is effected particularly advantageously when larger dimensions are selected for the openings 13. If a rectangular cross-section is selected for the through-holes 13, then it is perferable to have the longer sides of the holes 13 extending perpendicularly to the horizontal upper and lower edges of the baffle, the longer sides being at least 80 mms long and the shorter sides between 40 mms and 100 mms depending on the material processed. Advantageously the total area of the inlet ends (i.e. the upstream ends) of the openings 13 occupies at least two thirds of the area of the upstream surface 14 of the baffle 9.

As seen from FIG. 2, showing a section through a part of the baffle 9, the through-holes 13 become steadily wider from the upstream surface 14 of the baffle to its downstream surface. Advantageously, the angle $\beta$ formed between two opposed wall surfaces 18, 19 or each through-hole 13, i.e. the angle of divergence, lies in the range from 4° to 20°, and is preferably between 6° and 16°. By the openings 13 becoming wider in this way, jamming of crushed material in the openings is avoided.

Downstream from the baffle 9 in the direction of rotation R, the housing defines a second chamber 21 which is bounded radially outwardly of the rotor 2 by a curved wall 20 of the housing extending from the grate 7 to the material inlet 5. With this arrangement as shown, a substantial portion of the quantity of air which is conveyed in operation by the fan-like action of the hammer rotor 2 into the chamber 10 beneath the classifying grate 7, is conducted through the openings 13 in the baffle 9 into the chamber 21, and is guided by the housing wall 20 substantially in an arc back to the material inlet 5, assisted by the slight partial pressure prevailing at the inlet 5 in relation to the chamber 21.

It will thus be appreciated that a substantial portion of the air stream produced by the hammer rotor during operation is circulated around the rotor, thus reducing the quantity of air drawn in from the outside and hence also reducing the quantity of ar blown out through the classifying grate 7 for treatment by the dust extractor, which can thus be dimensioned accordingly.

I claim:

1. In a hammer breaker for breaking and crushing scrap material, said hammer breaker comprising a housing, a hammer rotor rotatably mounted within said housing, said rotor having a plurality of hammers pivotally mounted thereon, an inlet to said housing for the material to be broken and crushed, a passage defined by said housing for receiving broken and crushed material from said hammer rotor, a material outlet from said passage, and a material classifying grate covering said outlet, the improvement wherein said hammer breaker includes means dividing said passage into at least two chambers arranged in series in the direction of rotation of said rotor, and located radially outwardly from said rotor, said passage comprising a first chamber and a second chamber following said first chamber in the direction of rotation of said rotor, and said first chamber contains said material classifying grate and said second chamber opens into said inlet to said housing at a location spaced angularly from said first chamber.

2. A hammer breaker as claimed in claim 1, wherein said hammer rotor is mounted in said housing with the axis of rotation of said rotor horizontal, said first chamber of said first passage is located above said rotor, and said outlet covered by said classifying grate is located at the top of said first chamber above said rotor.

3. A hammer breaker as claimed in claim 2, wherein said classifying grate is horizontal.

4. A hammer breaker as claimed in claim 2, wherein said classifying grate is arcuate.

5. A hammer breaker as claimed in claim 1, wherein said first chamber of said passage is bounded radially outwardly from said rotor by said classifying grate covering said material outlet, and said housing has a curved wall which bounds said second chamber radially outwardly of said rotor, and said curved wall extends from said classifying grate to said material inlet.

6. A hammer breaker as claimed in claim 5, wherein said dividing means separating said first and second chambers comprises a baffle.

7. A hammer breaker as claimed in claim 6, wherein said baffle extends from said classifying grate to a position close to the impact circle described by the radially outer edges of said rotor hammers during rotation of said rotor.

8. A hammer breaker as claimed in claim 7, wherein said baffle extends from the edge of said classifying grate which is nearest the material inlet in the direction of rotation of said rotor.

9. A hammer breaker as claimed in claim 8, wherein said baffle extends almost perpendicularly to the plane of said classifying grate in such a way that the projection of said baffle onto said plane of said classifying grate lies outside the throughput area of said grate.

10. A hammer breaker as claimed in claim 6, wherein said baffle has openings passing through it and the total area of said openings in the face of said baffle adjacent said first chamber occupies at least two-thirds of the area of said face of said baffle.

11. A hammer breaker as claimed in claim 8, wherein said baffle extends in the direction of rotation of said rotor at an angle of from 10° to 30° to a plane passing through the edge of said baffle located adjacent said classifying grate and lying perpendicularly to the plane of said classifying grate.

12. A hammer breaker as claimed in claim 6, wherein said baffle is constructed as a grid, said grid having an upstream face within said first chamber, a downstream face within said second chamber, and a plurality of through holes extending from said upstream face to said downstream face, said through holes becoming steadily wider from said upstream face to said downstream face.

13. A hammer breaker as claimed in claim 12, wherein said through holes have a rectangular cross section with longer sides and shorter sides.

14. A hammer breaker as claimed in claim 13, wherein the longer sides of said rectangular through holes are at least 80 mms long in said upstream face of said grid baffle.

15. A hammer breaker as claimed in claim 13, wherein said grid baffle has horizontal edges and the longer sides of said rectangular through holes extend perpendicularly to the horizontal edges of said grid baffle.

16. A hammer breaker as claimed in claim 13, wherein the shorter sides of said rectangular through holes in said upstream face of said grid baffle are from 40 mms to 100 mms long, depending on the material processed.

17. A hammer breaker as claimed in claim 12, wherein the angle of divergence of said steadily widening through holes is not less than 4° and not more than 20°.

18. A hammer breaker as claimed in claim 17, wherein the said angle of divergence is from 6° to 16°.

* * * * *